US008015816B2

(12) United States Patent
Hall

(10) Patent No.: US 8,015,816 B2
(45) Date of Patent: Sep. 13, 2011

(54) APPARATUS FOR DISCOURAGING FUEL FROM ENTERING THE HEAT SHIELD AIR CAVITY OF A FUEL INJECTOR

(75) Inventor: Troy Hall, Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 658 days.

(21) Appl. No.: 12/139,945

(22) Filed: Jun. 16, 2008

(65) Prior Publication Data

US 2009/0308957 A1 Dec. 17, 2009

(51) Int. Cl.
*F02C 1/00* (2006.01)
*F02M 59/00* (2006.01)

(52) U.S. Cl. ..... 60/740; 60/737; 60/743; 60/748; 239/533.2

(58) Field of Classification Search ..... 60/737, 60/740, 742, 743, 746, 747, 748, 722, 734, 60/735, 744, 779; 239/533.2, 590
See application file for complete search history.

(56) References Cited

U.S. PATENT DOCUMENTS

| | | | | |
|---|---|---|---|---|
| 1,713,357 | A | 5/1929 | St. Clair | |
| 3,172,735 | A | 3/1965 | Schubach et al. | |
| 3,337,135 | A | 8/1967 | Prociw et al. | |
| 4,491,272 | A | 1/1985 | Bradley et al. | |
| 4,797,089 | A | 1/1989 | Schubach et al. | |
| 5,329,760 | A * | 7/1994 | Bradley et al. | 60/779 |
| 5,761,907 | A * | 6/1998 | Pelletier et al. | 60/740 |
| 5,882,514 | A | 3/1999 | Fletcher | |
| 6,082,113 | A | 7/2000 | Prociw et al. | |
| 6,276,141 | B1 | 8/2001 | Pelletier | |
| 6,354,072 | B1 * | 3/2002 | Hura | 60/776 |
| 6,457,316 | B1 | 10/2002 | Czachor et al. | |
| 6,539,724 | B2 | 4/2003 | Cornwell et al. | |
| 6,547,163 | B1 | 4/2003 | Mansour et al. | |
| 6,688,534 | B2 | 2/2004 | Bretz | |

FOREIGN PATENT DOCUMENTS

| | | | |
|---|---|---|---|
| EP | 1 245 900 | A2 | 10/2002 |
| WO | WO 2005/061964 | A1 | 7/2005 |
| WO | WO-2009039142 | A2 | 3/2009 |

OTHER PUBLICATIONS

Search Report for dated Oct. 8, 2009 for GB0910273.2.

* cited by examiner

*Primary Examiner* — Ehud Gartenberg
*Assistant Examiner* — Arun Goyal
(74) *Attorney, Agent, or Firm* — Scott D. Wofsy; Edwards Angell Palmer & Dodge LLP

(57) ABSTRACT

A gas turbine fuel injector includes a nozzle body having a radially inner wall proximate to an internal air path and a radially outer wall. An insulative gap is defined between the radially inner and outer walls. The inner and outer walls are adapted and configured for relative axial movement at a first interface. An inhibitor ring is disposed proximate a downstream end of the inner wall for discouraging fuel from entering the insulative gap. A second interface is formed between the downstream end of the inner wall and an upstream end of the inhibitor ring to accommodate relative axial movement of the inner and outer walls.

18 Claims, 5 Drawing Sheets

FIG. 1
(PRIOR ART)
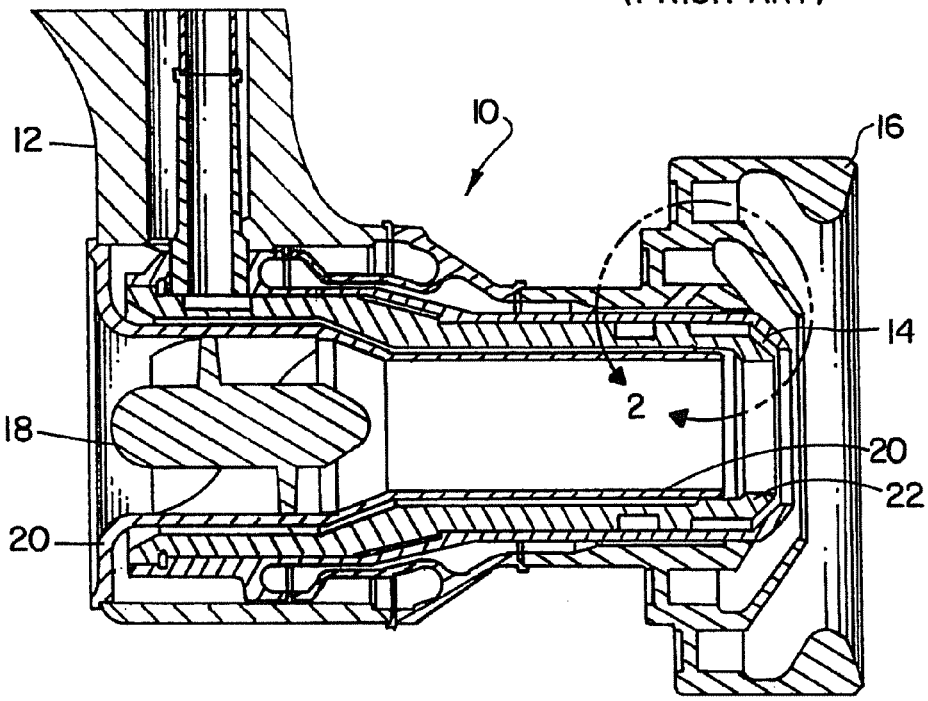
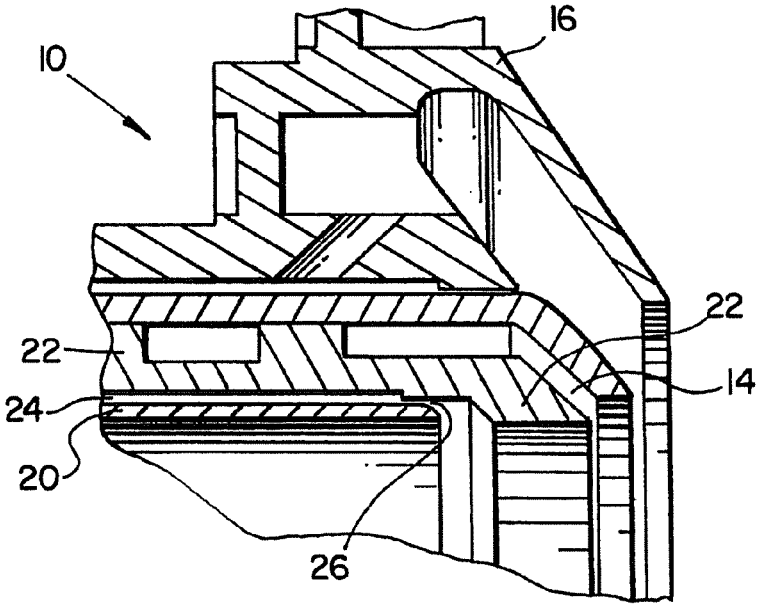
FIG. 2
(PRIOR ART)

APPARATUS FOR DISCOURAGING FUEL FROM ENTERING THE HEAT SHIELD AIR CAVITY OF A FUEL INJECTOR

BACKGROUND OF THE INVENTION

1. Field of the Invention

The present invention relates to fuel injectors for high temperature applications, and more particularly, to fuel injectors for gas turbine engines.

2. Description of Related Art

Nozzles for injecting fuel into the combustion chamber of gas turbine engines are well known in the art. U.S. Pat. No. 6,688,534 to Bretz, which is incorporated by reference herein in its entirety, describes several aspects of fuel nozzles for gas turbine injectors. Fuel injectors for gas turbine engines on an aircraft direct fuel from a manifold to a combustion chamber of a combustor. The fuel injector typically has an inlet fitting connected to the manifold for receiving the fuel, a fuel nozzle located within the combustor for spraying fuel into the combustion chamber, and a housing stem extending between and fluidly interconnecting the inlet fitting and the fuel nozzle. The housing stem typically has a mounting flange for attachment to the casing of the combustor.

Fuel injectors are usually heat-shielded because of high operating temperatures arising from high temperature gas turbine compressor discharge air flowing around the housing stem and nozzle components. The heat shielding prevents the fuel passing through the injector from breaking down into its constituent components (i.e., "coking"), which may occur when the wetted wall temperatures of a fuel passage exceed 400° F. The coke in the fuel passages of the fuel injector can accumulate and restrict fuel flow to the nozzle.

The compressor air flowing through a fuel injector can reach temperatures as high as 1600° F. Heretofore, injector nozzles have included annular stagnant air gaps as insulation between external walls, such as those in thermal contact with high temperature ambient conditions, and internal walls in thermal contact with the relatively cool fuel. These insulative air gaps are generally open to the ambient conditions to allow for relative thermal expansion of injector components. When the engine is not in operation, fuel can be drawn into the insulative air gaps, and when the engine is subsequently operated, this fuel in the insulative gaps can coke and thereby reduce the insulative effects of the heat shielding. Thus cleaning of the fuel injector is required to prevent reduced thermal insulation, potential carbon jacking and diminished nozzle service life.

Although some solutions to this problem have been developed, such as in U.S. Pat. No. 5,761,907 to Pelletier et al., which describes attaching the inner heat shield to the downstream tip of the injector while leaving the upstream end free for thermal expansion, there are disadvantages to leaving the upstream end of the heat shield free. Among the disadvantages are potentially severe failure effects that can be caused by a fuel leak in the insulative gap allowing fuel to flow out of the upstream vent into an undesirable area of the engine, e.g. upstream of the nozzle. Therefore, it is common practice to locate the vent downstream near the fuel exit of the nozzle. With the vent opening downstream near the nozzle exit, in the event of a failure causing an internal fuel leak, fuel can be directed to flow out of the vent and into the combustor downstream. This allows for further albeit limited engine operation until the injector can be replaced. Therefore it is desirable for the diametrical clearances between the heat shield and the fuel swirler to be located downstream, rather than upstream as described by Pelletier, et al.

Such conventional methods and systems generally have been considered satisfactory for their intended purpose. However, there still remains a continued need in the art for a nozzle or fuel injector that allows for differential expansion while reducing or preventing fuel entry into the insulative gaps. It is desirable for such a nozzle to vent the insulative gaps downstream rather than upstream in the nozzle. There also remains a need in the art for such a nozzle or injector that is inexpensive and easy to make and use. The present invention provides a solution for these problems.

SUMMARY OF THE INVENTION

The subject invention is directed to a gas turbine fuel injector. More particularly, the subject invention is directed to a gas turbine fuel injector including a nozzle body having a radially inner wall proximate to an internal air path and a radially outer wall. An insulative gap is defined between the radially inner wall and the radially outer wall. The inner and outer walls are adapted and configured for relative axial movement at a first interface. The injector further includes an inhibitor ring proximate a downstream end of the inner wall for discouraging fuel from entering the insulative gap. A second interface is formed between the downstream end of the inner wall and an upstream end of the inhibitor ring to accommodate relative axial movement of the inner and outer walls.

The inhibitor ring can be connected to the outer wall. In certain embodiments, the second interface has a clearance fit to allow gasses to vent therethrough while resisting passage of liquids therethrough. The second interface can advantageously form a vent for the insulative gap opening into the internal air path of the nozzle body in a direction facing away from a discharge outlet at downstream ends of the inner and outer walls. It is also possible for the inhibitor ring to be integral with the outer wall. The radially outer wall can include a fuel swirler defining a portion of a fuel path and the radially inner wall of the nozzle body can define a heat shield for protecting the fuel path.

It is envisioned that the inner wall can define a substantially cylindrical section of the internal air path through the nozzle body and that the inner wall can have a radially enlarged end portion downstream of the substantially cylindrical section. In this configuration, the radially enlarged end portion can form the first interface with the outer wall. The inhibitor ring can define a substantially cylindrical interior surface that has an inner diameter that is substantially equal to the inner diameter of the substantially cylindrical section of the inner wall. It is envisioned that the outer wall can have a substantially cylindrical portion proximate the discharge outlet that has an inner diameter that is substantially equal to the inner diameter of the substantially cylindrical surface of the inhibitor ring. Moreover, the fuel passage wall can include a stress relief feature defined therein adjacent to the inhibitor ring.

The invention also includes a gas turbine fuel injector including a nozzle body having opposed upstream and downstream ends and having a fuel passage extending therebetween. An inboard portion of the fuel passage is bounded by a fuel passage wall. An inner air path is bounded by a heat shield wall inboard of the fuel passage wall. The heat shield wall and the fuel passage wall are relatively longitudinally moveable at a first interface proximate the downstream end of the nozzle body. An internal insulating gap is interposed between the fuel passage wall and the heat shield wall. The insulating gap is in fluid communication with the inner air path through the first interface. An inhibitor ring connected to the fuel passage wall and overlapping a portion of the heat shield wall forms a second interface between the inhibitor ring and the heat shield wall proximate the first interface. The second interface is a tight clearance slip fit joint. The first and second interfaces are configured and adapted to allow passage of gasses and to resist passage of liquids therethrough.

The inhibitor ring can be relatively longitudinally moveable with the heat shield wall at the second interface. The heat shield wall can define a substantially cylindrical interior boundary in the inner air path and can have a radially enlarged downstream end portion, wherein the first interface is defined between the enlarged downstream end portion of the heat shield wall and the fuel passage wall. The inhibitor ring can overlap at least some of the radially enlarged downstream end portion of the heat shield wall. The fuel passage wall proximate a discharge outlet of the nozzle body can have a substantially cylindrical portion with a diameter that is substantially equal to the diameter of the substantially cylindrical interior boundary of the inner air path.

The invention also includes an air-blast fuel injector including an outer air swirler. A nozzle body inboard of the outer air swirler has an inlet at an upstream end and a discharge outlet at a downstream end. The nozzle body defines a fuel passage extending between the inlet and the discharge outlet. The fuel passage includes a fuel swirler and a downstream spin chamber. A fuel passage wall bounds an inboard portion of the fuel passage. A heat shield wall inboard of the fuel passage wall defines an inner air passage through the nozzle body. The fuel passage wall and the heat shield wall are relatively longitudinally moveable at a first interface. The fuel passage and heat shield walls define an internal insulating gap interposed therebetween to thermally insulate the fuel passage from the inner air passage. The internal insulating gap is in fluid communication with the inner air passage through the first interface. An inhibitor ring overlaps the first interface and is configured and adapted to discourage fuel from entering the insulating gap through the first interface. An inner air swirler body is disposed within the inner air passage. It is also contemplated that the inhibitor ring and the fuel passage wall can define a pocket therebetween for accommodating relative axial movement of a downstream end of the heat shield wall therein.

These and other features and benefits of the fuel injector of the subject invention will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the injector of the subject invention without undue experimentation, preferred embodiments thereof will be described in detail hereinbelow with reference to certain figures, wherein:

FIG. 1 is a cross-sectional, side elevation view of a prior art fuel injector;

FIG. 2 is an enlarged cross-sectional, side elevation view of a portion of the prior art fuel injector of FIG. 1, showing the insulative gap between the inner fuel passage wall and the heat shield;

DETAILED DESCRIPTION OF THE PREFERRED EMBODIMENTS

Figure 3:
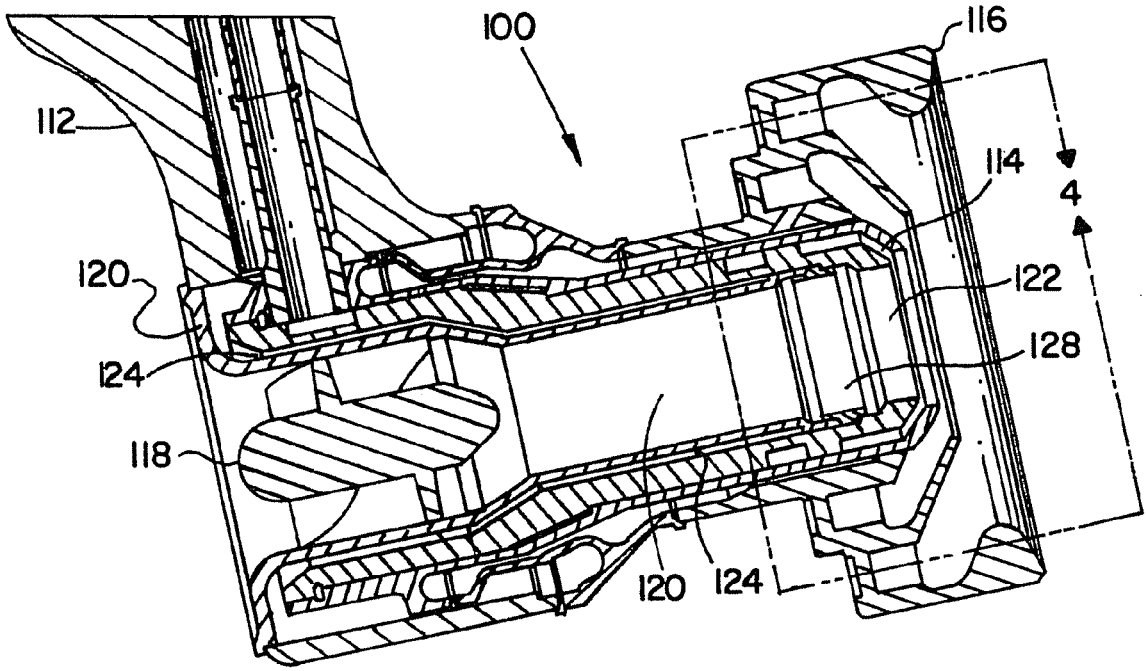
FIG. 3 is a cross-sectional, side elevation view of a first representative embodiment of a fuel injector in accordance with the present invention, showing the inhibitor ring in the inner air passage.

Referring now to the drawings, wherein like reference numerals identify or otherwise refer to similar structural features or elements of the various embodiments of the subject invention, there is illustrated in FIG. 3 a gas turbine fuel injector constructed in accordance with the subject invention and designated generally by reference numeral 100. As illustrated, injector 100 is an airblast injector provided for issuing atomized fuel into the combustion chamber of a gas turbine engine.

Referring now to FIG. 1, prior art injector 10, allows fuel flowing through upstream passages in stem 12 to follow fuel passages defined in fuel passage wall 22 to be injected downstream through annular orifice 14. Relatively hot, compressed air issuing from an upstream compressor passes into inner air swirler 18 and outer air swirler 16. Swirled air from the inner and outer air swirlers 16, 18 shears fuel injected from orifice 14 into droplets and atomizes the fuel for combustion downstream in the combustor.

In order to shield the fuel flowing along fuel passage wall 22 from the hot compressor gas passing through swirler 18, a heat shield 20 is disposed in the inner air passage. FIG. 2 shows an enlarged section of injector 10 proximate the annular fuel orifice 14. Fuel exiting through orifice 14 must first flow through passages defined in the radially outer surface of fuel passage wall 22. Hot compressor air from air swirler 18 flows through heat shield 20. An insulative gap 24 separates fuel passage wall 22 from heat shield 20 to thermally isolate the fuel stream from the relatively hot compressor air in the inner air passage.

In order to accommodate differential expansion of the internal and external walls while minimizing thermally induced stresses, the walls heretofore have been anchored at one end and free at the other end for relative movement. A small interface 26 between heat shield 20 and fuel passage wall 22 allows for relative movement of heat shield 20 and fuel passage wall 22 along the axis of injector 10. This reduces thermally induced stresses in injector 10 when heat shield 20 thermally expands in the presence of hot compressor air, while fuel passage wall 22 remains relatively unexpanded due to contact with the relatively cool fuel flowing to orifice 14. In addition to allowing for relative thermal expansion, interface 26 allows gasses in insulative gap 24 to vent, allowing the gasses to freely expand and contract within gap 24, thus alleviating the build up of pressure and consequent stresses in neighboring components.

If the downstream ends of the walls are left free for relative movement, even a close fitting sliding interface between the downstream ends can allow fuel to pass into the air gap 24 formed between the walls. For example, when injector 10 is not in operation, excess fuel from orifice 14 can be drawn through interface 26 into insulative gap 24. This can result from capillary action, gravity, and/or suction from contracting gasses in gap 24 acting on the fuel at interface 26.

Fuel entering insulative gap 24 can reduce the effectiveness of insulative gap 24 in thermally isolating fuel flowing to orifice 14 from compressor gases flowing through heat shield 20. Repeated engine shut-down/start-up cycles can cause the air gap to become filled with carbon as coking occurs in fuel remaining in insulative gap 24. Carbon is not as good an insulator as air, thus the air gap 24 can lose much of its insulation ability over time. Cleaning is frequently required to prevent carbon build up from reaching a point where it blocks venting of insulative gap 24 through interface 26.

Figure 4:
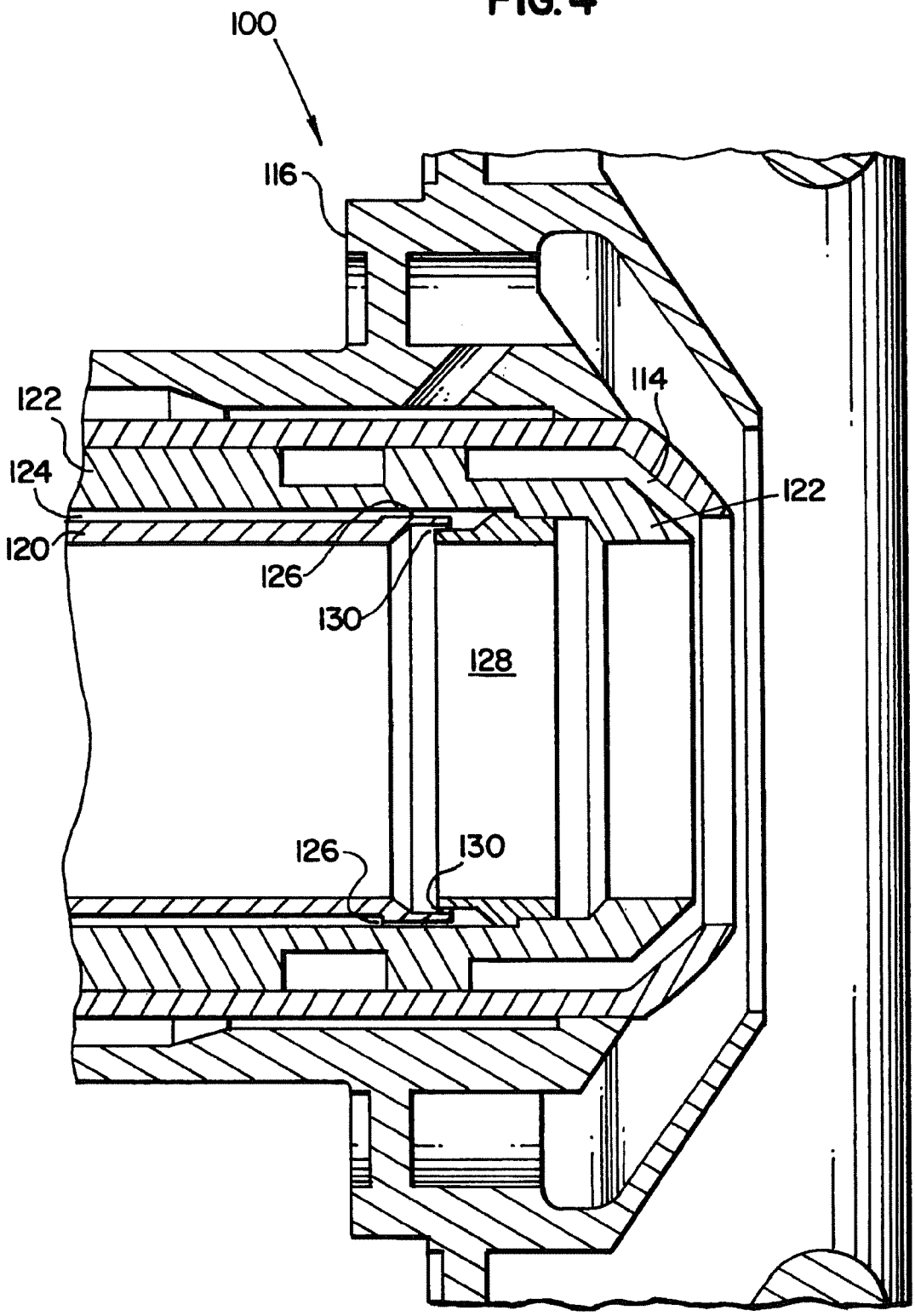
FIG. 4 is an enlarged cross-sectional, side elevation view of a portion of the fuel injector of FIG. 3, in accordance with the present invention, showing the interface between the heat shield and the inner fuel passage wall, as well as the interface between the heat shield wall and the inhibitor ring.

In accordance with the invention, and as shown in FIGS. 3 and 4, an injector 100 is provided extending from a stem 112, which delivers fuel to be injected through annular orifice 114 into a combustor downstream. An outer air swirler 116 is located radially outward from annular orifice 114, and an inner air swirler 118 is located radially inward from orifice 114. Heat shield 120 is provided in the inner air passage spaced apart from fuel passage wall 122 across insulative gap 124, in order to thermally isolate fuel passing from stem 112 to orifice 114, as described above with respect to gap 24 of injector 10. Since upstream portions of heat shield 120 and inner fuel passage wall 122 are attached at stem 112, the down stream ends thereof are free to move axially relative to one another, as when thermally expanding and contracting.

Fuel passage wall 122 is shown as being a fuel swirler including swirl vanes for imparting swirl onto a flow of fuel passing therethrough prior to exiting a swirl chamber or orifice 114. However, while insulative gap 124 is shown between heat shield 120 and fuel passage wall 122, those skilled in the art will appreciate that any two radially inner and radially outer components can be used to form the insulative gap therebetween in lieu of heat shield 120 and fuel passage wall 122 without departing from the spirit and scope of the invention. For example, gap 124 can be formed between inner heat shield 120 and an intermediate heat shield inboard of fuel passage wall 122.

As shown in FIG. 4, inhibitor ring 128 is disposed radially inward from fuel passage wall 122 near fuel orifice 114. Inhibitor ring 128 can be brazed or welded to fuel passage wall 122, can be affixed with an interference fit, or can be attached by any other suitable means. Those skilled in the art will readily appreciate that inhibitor ring 128 can also be formed integral with fuel passage wall 122. While there is no insulative gap across the joint between inhibitor ring 128 and wall 122, the joint is adjacent the fuel swirler vanes and swirl chamber or orifice 114, which is a region with high fuel velocity and adequate cooling to prevent coking. Moreover, while inhibitor ring 128 is subject to thermal expansion and compression, during operation the joint between inhibitor ring 128 and wall 122 goes into compression, which results in little or no mechanical fatigue.

The downstream end of heat shield 120 nearest orifice 114 is enlarged radially to have a narrow clearance with fuel passage wall 122. This narrow clearance forms a first interface 126, which preferably has a tight enough clearance to allow passage of gases but to resist passage of liquids. Interface 126 allows heat shield 120 to expand axially toward orifice 114 when heated by passing compressor air, relative to fuel passage wall 122, which expands less because of its contact with the relatively cool fuel flowing to orifice 114.

A second interface 130 is located between the enlarged end of heat shield 120 and inhibitor ring 128. Second interface 130 is dimensioned to have enough clearance to allow venting of gases to and from insulative gap 124 but to have tight enough clearance to discourage or prevent fuel from passing therethrough. Second interface 130 provides clearance for the radially enlarged end of heat shield 120 to move axially with respect to inhibitor ring 128 as heat shield 120 thermally expands and contracts. A small pocket is formed between heat shield 120, inhibitor ring 128, and fuel passage wall 122, which accommodates the end of heat shield 120 when moving axially with respect neighboring components.

Especially during shut down of a gas turbine engine, excess fuel from orifice 114 tends to flow in a direction back from orifice 114 upstream into the inner air passage and neighboring components. The entrance from the inner air passage into interface 130 opens in a direction away from the typical incoming flow of excess fuel from orifice 114. In this manner, interface 130 directs excess fuel away from the slip fit region, including first interface 126. Thus, the orientation of interface 130, in addition to the tight clearance thereof, discourages external fuel entering insulative gap 124. Since fuel would have to pass two tight interfaces 126, 130 in a tortuous path in order to enter insulative gap 124, fuel is discouraged from entering gap 124 to a much greater extent than in known fuel injectors. Those skilled in the art will readily appreciate that it is not necessary for both of interfaces 126 and 130 to be tight interfaces. For example, it is possible for only interface 130 to be a tight interface, in which case it would not be necessary for interface 126 to be a tight interface.

The interior of heat shield 120 defines a generally cylindrical inner air passage with downstream vents. The radially inner surface of inhibitor ring 128 is substantially aligned with the cylindrical inner air passage defined by the radially inner surface of heat shield 120. With ring 128 substantially flush radially with heat shield 120, inhibitor ring 128 does not form a significant obstruction to the flow of compressor air through the inner air passage. However, it is also possible for the end of heat shield 120, rather than being enlarged, to be of the same diameter as the adjacent portion of heat shield 120. The inner surface of inhibitor ring 128 can extend radially into the inner air passage rather than being flush therewith. The inner diameter of inhibitor ring 128 can be smaller or larger than the inner diameter of heat shield 120, as long as inhibitor ring and heat shield 120 are dimensioned to accommodate the required flow of air through the inner air passage. Those skilled in the art will readily appreciate that any suitable configuration of heat shield wall and inhibitor ring can be used without departing from the spirit and scope of the invention.

Fuel passage wall 122 has a tip adjacent orifice 114 that includes a radially inner cylindrical surface that is substantially flush with the inner air passage. As shown in FIG. 4, the tip of fuel passage wall 122 has an inner diameter that is substantially equal to the diameter of the inner air passage. However, those skilled in the art will appreciate that the diameter of the tip of fuel passage wall 122 can be smaller or larger than the diameter of the inner air passage. Moreover, any other suitable tip geometry can be used without departing from the spirit and scope of the invention.

Figure 5:
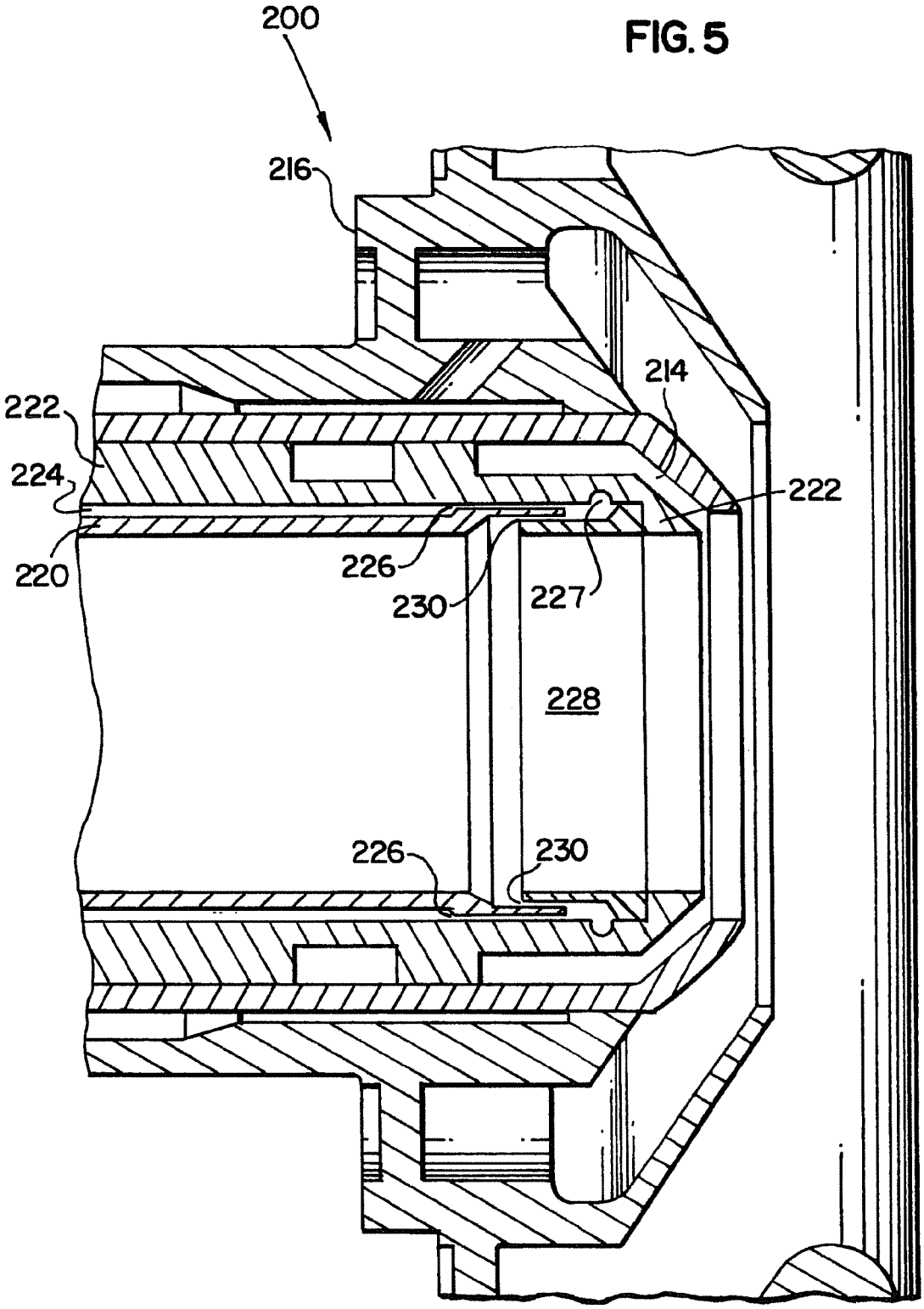
FIG. 5 is an enlarged cross-sectional, side elevation view of a portion of another embodiment of a fuel injector in accordance with the present invention, showing an inhibitor ring affixed in an inner air passage with a stress relief feature defined in the fuel swirler wall adjacent to the inhibitor ring.

FIG. 5 shows a portion of another fuel injector 200 having an outer air swirler 216, fuel passage wall 222, fuel orifice 214, insulative air gap 224, heat shield 220, and inhibitor ring 228. Inhibitor ring 228 is affixed substantially flush both axially and radially with the tip portion of fuel passage wall 222. Inhibitor ring 228 and the tip of fuel passage wall 222 have inner diameters that are substantially equal to the inner diameter of heat shield 220. Heat shield 220 and inhibitor ring 228 are relatively longitudinally moveable at interfaces 226 and 230 to accommodate for thermal expansion and contraction in the axial direction, much as described above with respect to injector 100. Fuel passage wall 222 includes a stress relief feature 227 adjacent to inhibitor ring 228 to accommodate for radial thermal expansion/contraction of inhibitor ring 228 and/or the tip of fuel passage wall 222. Those skilled in the art will appreciate that any suitable shape and size can be used for such a stress relief feature without departing from the spirit and scope of the invention.

Figure 6:
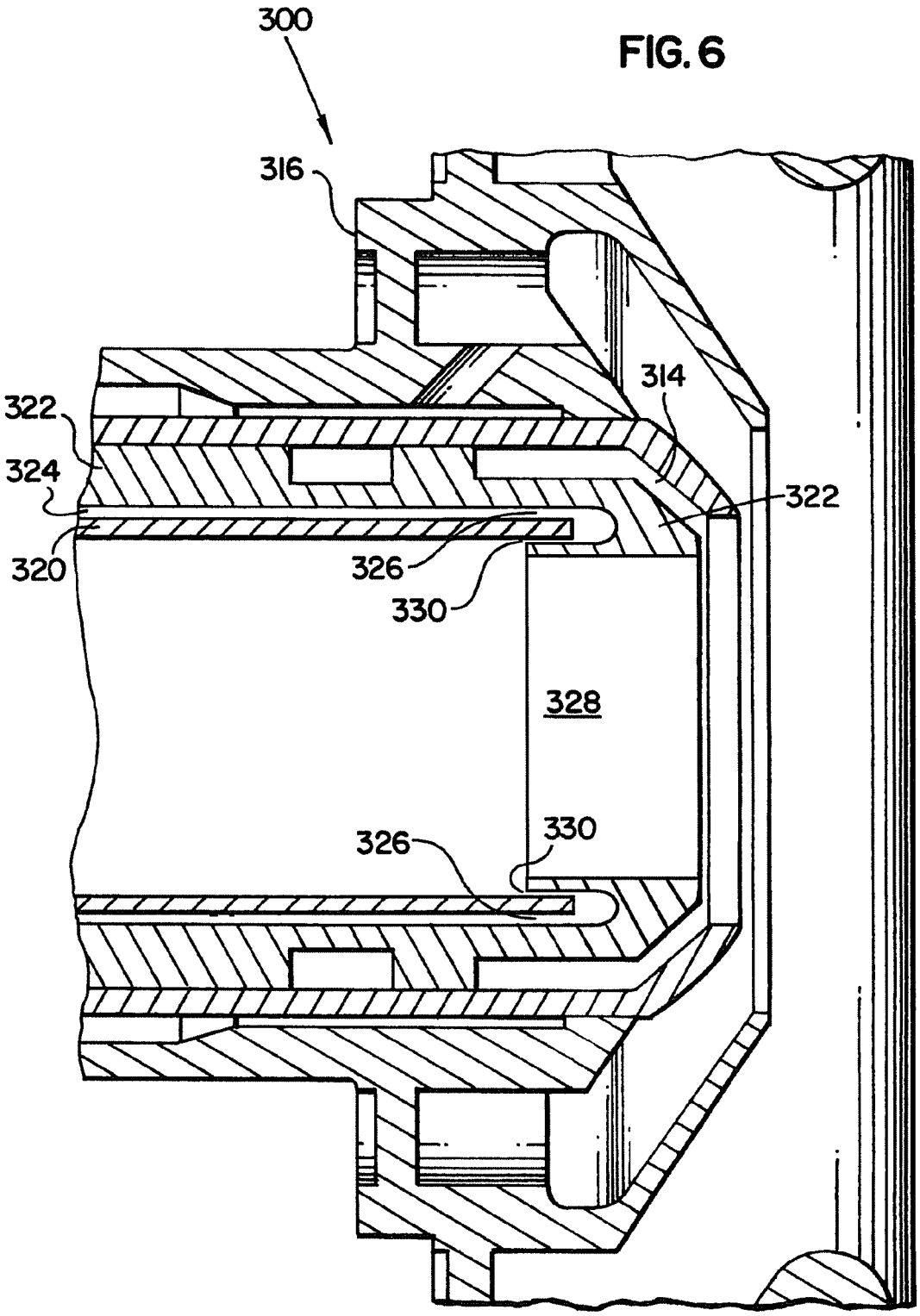
FIG. 6 is an enlarged cross-sectional, side elevation view of a portion of another embodiment of a fuel injector in accordance with the present invention, showing an inhibitor ring that is integral with the adjacent fuel swirler wall.

FIG. 6 shows a portion of another fuel injector 300 having an outer air swirler 316, fuel passage wall 322, fuel orifice 314, insulative air gap 324, heat shield 320, and inhibitor ring 328. Inhibitor ring 328 is an integral part of fuel passage wall 322. Inhibitor ring 328 has an inner diameter that is slightly smaller than the inner diameter of heat shield 320. Heat shield 320 and inhibitor ring 328 are relatively longitudinally moveable at interfaces 326 and 330 to accommodate for thermal expansion and contraction in the axial direction, much as described above with respect to injector 100. However, unlike in injector 100, the downstream tip of heat shield 320 is not enlarged with respect to the rest of heat shield 320. This configuration has a lower part count, and fewer joints between parts.

While the invention has been described in conjunction with an exemplary air blast fuel injector, those skilled in the art will readily appreciate that the invention is not limited to use with air blast fuel injectors. The methods and devices of the invention can be used in conjunction with any suitable injector or nozzle without departing from the spirit and scope of the invention.

The systems of the present invention, as described above and shown in the drawings, provide for a fuel injector with superior properties including discouraging or preventing fuel from entering insulation gaps, allowing insulation gaps to vent near the fuel orifice, and providing for relative axial motion of injector components due to thermal expansion. This can extend the useable life and decrease maintenance required in injectors. It will be apparent to those skilled in the art that various modifications and variations can be made in the device and method of the present invention without departing from the spirit or scope of the invention. Thus, while the fuel injector of the subject invention has been described with respect to preferred embodiments, those skilled in the art will readily appreciate that changes and modifications may be made thereto without departing from the spirit and scope of the subject invention as defined by the appended claims.

What is claimed is:

1. A gas turbine fuel injector comprising:

a) a nozzle body having a radially inner wall proximate to an internal air path and a radially outer wall, wherein an insulative gap is defined between the radially inner wall and the radially outer wall, and wherein the inner and outer walls are adapted and configured for relative axial movement at a first interface; and b) an inhibitor ring proximate a downstream end of the inner wall for discouraging fuel from entering the insulative gap, wherein a second interface is formed between the downstream end of the inner wall and an upstream end of the inhibitor ring to accommodate relative axial movement of the inner and outer walls, wherein the second interface forms a vent for the insulative gap opening into the internal air path of the nozzle body in a direction facing away from a discharge outlet at downstream ends of the inner and outer walls.

2. A gas turbine fuel injector as recited in claim 1, wherein the inhibitor ring is connected to the outer wall.

3. A gas turbine fuel injector as recited in claim 2, wherein the second interface has a clearance fit to allow gasses to vent therethrough while resisting passage of liquids therethrough.

4. A gas turbine fuel injector as recited in claim 1, wherein the inner wall defines a substantially cylindrical section defining an internal air path through the nozzle body, wherein the inner wall has a radially enlarged end portion downstream of the substantially cylindrical section, and wherein the radially enlarged end portion forms the first interface with the outer wall.

5. A gas turbine fuel injector as recited in claim 4, wherein the inhibitor ring defines a substantially cylindrical interior surface having an inner diameter that is substantially equal to the inner diameter of the substantially cylindrical section of the inner wall.

6. A gas turbine fuel injector as recited in claim 5, wherein the outer wall has a substantially cylindrical portion proximate the discharge outlet that has an inner diameter substantially equal to the inner diameter of the substantially cylindrical surface of the inhibitor ring.

7. A gas turbine fuel injector as recited in claim 1, wherein the inhibitor ring is integral with the outer wall.

8. A gas turbine fuel injector as recited in claim 1, wherein the radially outer wall includes a fuel swirler defining a portion of a fuel path, and wherein the radially inner wall of the nozzle body defines a heat shield for protecting the fuel path.

9. A gas turbine fuel injector comprising:

a) a nozzle body having opposed upstream and downstream ends and having a fuel passage extending therebetween, wherein an inboard portion of the fuel passage is bounded by a fuel passage wall;

b) an inner air path bounded by a heat shield wall inboard of the fuel passage wall, wherein the heat shield wall and the fuel passage wall are relatively longitudinally moveable at a first interface proximate the downstream end of the nozzle body, wherein an internal insulating gap is interposed between the fuel passage wall and the heat shield wall, and wherein the insulating gap is in fluid communication with the inner air path through the first interface; and c) an inhibitor ring connected to the fuel passage wall and overlapping a portion of the heat shield wall to form a second interface between the inhibitor ring and the heat shield wall proximate the first interface, the second interface being a tight clearance slip fit joint, wherein the first and second interfaces are configured and adapted to allow passage of gasses and to resist passage of liquids therethrough, wherein the second interface forms a vent for the insulating gap opening into the inner air path in a direction facing away from the downstream end of the nozzle body.

10. A gas turbine fuel injector as recited in claim 9, wherein the inhibitor ring is relatively longitudinally moveable with the heat shield wall at the second interface.

11. A gas turbine fuel injector as recited in claim 9, wherein the fuel passage wall includes a stress relief feature defined therein adjacent to the inhibitor ring.

12. A gas turbine fuel injector as recited in claim 9, wherein the heat shield wall defines a substantially cylindrical interior boundary in the inner air path and includes a radially enlarged downstream end portion, wherein the first interface is defined between the enlarged downstream end portion of the heat shield wall and the fuel passage wall.

13. A gas turbine fuel injector as recited in claim 12, wherein the inhibitor ring overlaps at least some of the radially enlarged downstream end portion of the heat shield wall.

14. A gas turbine fuel injector as recited in claim 13, wherein the inhibitor ring defines a substantially cylindrical interior surface having an inner diameter that is substantially equal to the inner diameter of the substantially cylindrical interior boundary of the inner air path.

15. A gas turbine fuel injector as recited in claim 14, wherein the fuel passage wall proximate a discharge outlet of the nozzle body has a substantially cylindrical portion having an inner diameter that is substantially equal to the inner diameter of the substantially cylindrical interior boundary of the inner air path.

16. A gas turbine fuel injector as recited in claim 9, wherein the inhibitor ring is integral with the fuel passage wall.

17. An air-blast fuel injector comprising:

a) an outer air swirler;

b) a nozzle body inboard of the outer air swirler having an inlet at an upstream end and a discharge outlet at a downstream end, the nozzle body defining a fuel passage extending between the inlet and the discharge outlet, wherein the fuel passage includes a fuel swirler and a downstream swirl chamber;

c) a fuel passage wall bounding an inboard portion of the fuel passage;

d) a heat shield wall inboard of the fuel passage wall defining an inner air passage through the nozzle body, wherein the fuel passage wall and the heat shield wall are relatively longitudinally moveable at a first interface, and wherein the fuel passage and heat shield walls define an internal insulating gap interposed therebetween to thermally insulate the fuel passage from the inner air passage, wherein the internal insulating gap is in fluid communication with the inner air passage through the first interface;

e) an inhibitor ring overlapping the first interface, the inhibitor ring being configured and adapted to discourage fuel from entering the insulating gap through the first interface, wherein a second interface is formed between a downstream end of the heat shield wall and an upstream end of the inhibitor ring to accommodate relative axial movement of the heat shield wall and the fuel passage wall, wherein the second interface forms a vent for the internal insulating gap opening into the inner air passage of the nozzle body in a direction facing away from the discharge outlet; and f) an inner air swirler body disposed within the inner air passage.

18. An air-blast fuel injector as recited in claim 17, wherein the inhibitor ring and the fuel passage wall define a pocket therebetween for accommodating relative axial movement of a downstream end of the heat shield wall therein.

* * * * *